US009101228B2

(12) United States Patent
Kaperst et al.

(10) Patent No.: US 9,101,228 B2
(45) Date of Patent: Aug. 11, 2015

(54) SHELF SYSTEM FOR ELONGATED ARTICLES

(71) Applicants: Michael Kaperst, Washington, DC (US); James Weintraub, Huntingtown, MD (US)

(72) Inventors: Michael Kaperst, Washington, DC (US); James Weintraub, Huntingtown, MD (US)

(73) Assignee: One Rack LLC, Lanham, MD (US)

( * ) Notice: Subject to any disclaimer, the term of this patent is extended or adjusted under 35 U.S.C. 154(b) by 0 days.

(21) Appl. No.: 13/624,230

(22) Filed: Sep. 21, 2012

(65) Prior Publication Data

US 2013/0048584 A1 Feb. 28, 2013

Related U.S. Application Data

(63) Continuation-in-part of application No. 13/329,913, filed on Dec. 19, 2011, now abandoned, which is a continuation of application No. 12/153,330, filed on May 16, 2008, now abandoned.

(51) Int. Cl.

| | |
|---|---|
| ***A47F 1/04*** | (2006.01) |
| ***A47F 7/00*** | (2006.01) |
| ***A47B 81/00*** | (2006.01) |

(52) U.S. Cl.

CPC ..... *A47F 7/0035* (2013.01); *A47B 81/00* (2013.01)

(58) Field of Classification Search

CPC .... B25H 3/04; A47B 73/006; A47B 87/0207; A47B 87/0215; A47B 8/0253; A47B 87/0276; A47B 87/0292; A47B 81/00; B65G 1/0442; A47F 7/0035

USPC ..... 211/70.8, 60.1, 62, 65, 69.5, 70.2, 70.4, 211/85.18, 85.21, 70.6; 43/21.2, 25, 54.1; 206/315.11, 372; 224/922; 248/512; 446/108; 52/405.1

See application file for complete search history.

(56) References Cited

U.S. PATENT DOCUMENTS

| | | | | |
|---|---|---|---|---|
| 418,435 | A | 12/1889 | Besse | |
| 873,496 | A * | 12/1907 | Bryant | 211/188 |
| 1,915,020 | A | 6/1933 | Goldstein | |
| 2,379,126 | A * | 6/1945 | Welden | 220/563 |
| 2,791,255 | A | 5/1957 | Ogden | |
| 2,815,863 | A | 12/1957 | Larson | |
| 3,145,031 | A | 8/1964 | Carl | |
| 3,298,531 | A | 1/1967 | Carl | |
| 3,298,532 | A | 1/1967 | Carl | |
| 3,606,023 | A * | 9/1971 | Edmunds | 211/74 |
| 3,759,538 | A | 9/1973 | Fabiano | |
| 3,819,034 | A | 6/1974 | Clark | |
| 3,888,353 | A * | 6/1975 | Leifheit | 211/37 |
| 4,039,132 | A * | 8/1977 | Fournier | 248/150 |
| 4,099,626 | A * | 7/1978 | Magnussen, Jr. | 211/60.1 |
| 4,196,812 | A * | 4/1980 | McInnis | 211/40 |
| 4,410,095 | A * | 10/1983 | Dembicks | 211/70.6 |
| 4,742,782 | A * | 5/1988 | Miller | 108/107 |
| 4,819,814 | A * | 4/1989 | Fogelgren | 211/50 |
| 4,890,731 | A * | 1/1990 | Mroz | 206/315.9 |
| 4,981,224 | A * | 1/1991 | Rushing | 211/126.12 |

(Continued)

*Primary Examiner* — Korie H Chan

(74) *Attorney, Agent, or Firm* — Cozen O'Connor

(57) ABSTRACT

A modular shelf system comprising: (i) at least two panels comprising a set of modular inserts of a predetermined size and shape, having holes disposed in said modular inserts; and (ii) means for maintaining said panels substantially parallel to one another at a predetermined distance apart, wherein said holes is dimensioned to accept a plurality of articles to be stored, in a substantially planer form even when placed under a load.

19 Claims, 9 Drawing Sheets

(56) References Cited

U.S. PATENT DOCUMENTS

| | | | | | |
|---|---|---|---|---|---|
| 5,011,028 | A | | 4/1991 | Sweeney | |
| 5,172,816 | A | * | 12/1992 | Kline et al. | 211/37 |
| 5,222,610 | A | * | 6/1993 | Johansen et al. | 211/69.5 |
| 5,267,648 | A | * | 12/1993 | Baker | 206/446 |
| 5,415,297 | A | * | 5/1995 | Klein et al. | 211/40 |
| 5,495,954 | A | | 3/1996 | Schmit | |
| 5,810,177 | A | | 9/1998 | Cabiran | |
| D403,880 | S | * | 1/1999 | Malik | D6/411 |
| 5,992,647 | A | * | 11/1999 | Malik | 211/34 |
| 6,086,172 | A | * | 7/2000 | Lee | 312/108 |
| 6,615,562 | B2 | * | 9/2003 | Fritsche et al. | 52/696 |
| 7,000,787 | B2 | * | 2/2006 | Felsenthal | 211/175 |
| 7,063,218 | B2 | | 6/2006 | Pleiman et al. | |
| 7,080,864 | B2 | * | 7/2006 | Casteran | 294/67.3 |
| D587,490 | S | * | 3/2009 | Siegel | D6/459 |
| 2007/0017884 | A1 | | 1/2007 | Yang | |

* cited by examiner

SHELF SYSTEM FOR ELONGATED ARTICLES

CROSS REFERENCE TO RELATED APPLICATIONS

The present application is a continuation-in-part of application Ser. No. 13/329,913, filed Dec. 19, 2011, which is a continuation of Ser. No. 12/153,330, filed May 16, 2008, now abandoned, which are incorporated herein by reference in their entirety.

FIELD OF THE INVENTION

This invention relates to shelf systems, in particular shelf systems which are used to support, display and/or organize articles having a length substantially greater than their width or diameter. Such elongated articles include, but are not limited to, the following: construction materials, such as pipes, moldings, lumber, extrusions and the like; garden tools, such as rakes, hoes, shovels, picks and the like; and home cleaning tools, such as brooms, mops and the like.

DESCRIPTION OF THE RELATED ART

In any retail business, storage and display of merchandise and inventory is a fundamental concern. While it is usually desirable to maximize the exposure of merchandise and inventory to potential customers seeking to purchase, it is just as important to preserve and maintain the quality and integrity of such articles. Moreover, it is also important to ensure the most efficient use of space within the business. Similar considerations attach in other situations, including industrial settings, offices and homes and residences, where it is often necessary to store and/or organize articles.

These concerns are magnified in the case of elongated articles, i.e. items having a length substantially greater than their width or diameter. Such elongated articles include, but are not limited to, the following: construction materials, such as pipes, rods, moldings, extrusions, boards, dowels and the like; gardening tools, such as rakes, shovels, hoes and the like; household cleaning tools, such as mops, brooms and the like; office articles, such as rolled plans, spreadsheets, blueprints and the like; bolts of fabric; coils of fibers or wire; etc.

These elongated articles are, of course, too long to fit comfortably into any conventional drawer. Accordingly, these articles are generally stored by being stood on end in a corner or in a rack of some type, or by hanging them on a wall rack or a nail, or simply laying them in a pile on the floor. Each of these approaches has problems.

For example, if the articles are stood on end in a corner, then elongated articles with enlarged ends, such as rakes or brooms, will not fit well. If there are many articles, then they will look messy and will not be easily accessible or even viewable. It is also quite possible that the articles will get damaged, for example by rubbing or bumping against one another. Moreover, if unsupported, one or more articles may topple over and injure someone and/or damage the item(s). Articles stored vertically can also be damaged and/or cause damage or injury when being handled, for example when being removed for purchase.

Similarly, if piled on the floor, the articles will look messy and will not be easily accessible or even viewable. Also, to get an article at the bottom of the pile, one would need to disassemble and then reassemble the whole pile. It is also likely that one or more articles may get damaged in the pile. Moreover, articles stored in a pile, such as pipe and the like, can roll over and fall on someone.

If the articles are hung a hook or nail on the wall or ceiling, the items may still fall and possibly injure someone. Moreover, most construction materials, such as pipes, dowels, molding and the like, do not have a hole or similar recess to hold them on a hook or nail, or even a bulge to hold them between such supports.

Many solutions have been proposed for racks or shelf systems to store, hold and/or display elongated items. Such proposals include: U.S. Pat. No. 418,435 for a "Display Rack for Tools"; U.S. Pat. No. 1,915,020 for an "Umbrella Holder"; U.S. Pat. No. 2,815,863 for "A Garden Tool Stand"; U.S. Pat. No. 3,145,031 for a "Mobile Tool Supporting Apparatus"; U.S. Pat. No. 3,298,531 for "Devices For Storing Tools And The Like"; U.S. Pat. No. 3,298,532 for "Device For Storing Articles"; U.S. Pat. No. 3,759,538 for a "Garden Kaddy"; U.S. Pat. No. 3,819,034 for a "Shipping and Display Arrangement for Brooms"; U.S. Pat. No. 4,742,782 for a "Sheet Metal Shelving Assembly"; U.S. Pat. No. 5,011,028 for an "Adjustable Arrow Holder"; U.S. Pat. No. 5,810,177 for a "Versatile Tool Rack Assembly"; U.S. Pat. No. 7,063,218 for an "Anti-Tip Rack for Long Handled Tools"; and U.S. Patent Publication No. US 2007/0017884 for a "Modular Wine Rack".

Each of these proposed solutions, however, has one or problems which have limited their acceptance and/or use by the industry. Accordingly, there remains a need for a shelf system for supporting, displaying and/or organizing elongated articles.

SUMMARY OF THE INVENTION

It is an object of the present invention to overcome the deficiencies of known and available racks and shelf systems. It is further an object of the present invention to provide a shelf system for supporting, displaying and/or organizing elongated items.

In accordance with these and other objects, a first embodiment of the present invention is directed to a shelf system comprising: (i) at least two modular panels of predetermined size and shape, each modular panel having a plurality of modular inserts, each insert having at least one hole, and (ii) means for maintaining said panels substantially parallel to one another at a predetermined distance apart, wherein each of the panels has a first surface and a second surface and an edge and contains a plurality of holes extending completely through the panel from the first surface to the second surface, wherein each of the plurality of holes is dimensioned to accept a plurality of articles to be stored, wherein each of the panels comprises a material having a bending modulus sufficient to maintain said panel in a substantially planer form even when placed under a load, and wherein the panels are arranged such that at least one hole on one of said panels is substantially aligned with at least one hole on the other of said panels.

A further embodiment of the present invention is directed to a shelf system comprising: (i) at least two modular panels of predetermined size and shape, each modular panel having a plurality of modular inserts, each insert having at least one hole, wherein each of the panels has a first surface and a second surface and an edge, wherein each edge contains at least one notch, (ii) rigid support members configured to receive said notch in said edge of said panels to maintain said panels substantially parallel to one another, and (iii) wherein each panel contains a plurality of holes extending completely through the panel from the first surface to the second surface, wherein each of the plurality of holes is dimensioned to accept a plurality of articles to be stored, wherein each of the panels comprises a material having a bending modulus sufficient to maintain said panel in a substantially planer form even when placed under a load, and wherein the panels are arranged such that at least one hole on one of said panels is substantially aligned with at least one hole on the other of said panels.

DETAILED DESCRIPTION OF THE FIGURES

As used herein the term "about" means within 10% of a stated number.

As used herein, terms such as "a," "an," and "the" include singular and plural referents unless the context clearly demands otherwise.

Figure 1:
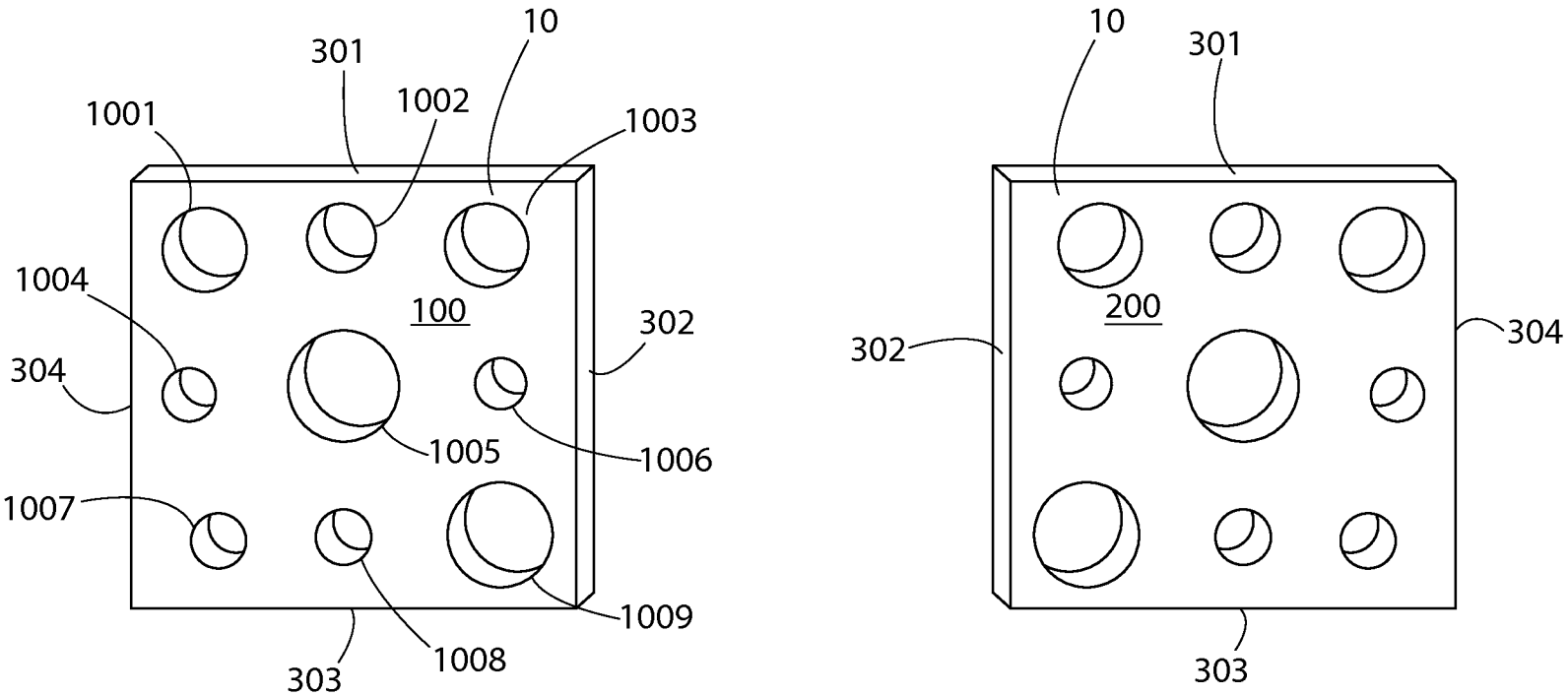
FIG. 1 shows an exemplary panel 10 that may be used in the inventive shelf system.

Referring now to the drawings, FIG. 1 shows an exemplary panel 10 that may be used in the inventive shelf system. This exemplary panel is shown to have a substantially square shape, but any suitable shape may be employed including circles, ellipses and polygons. As shown in FIG. 1, the exemplary panel 10 has a first surface 100 and a second surface 200 and a plurality of edges 301-304.

The exemplary panel 10 contains a plurality of holes 1001-1009 that extend completely through the panel 10 from the first surface 100 to the second surface 200. The size of the panel(s) used in the inventive shelf system may be determined empirically depending, for example, on the number of holes desired and the width or diameter of the articles intended to be stored, displayed and/or organized.

Each of the plurality of holes 1001-1009 is dimensioned to accept a plurality of articles to be stored, displayed and/or organized. Each of the plurality of articles is an elongated article which has a length substantially greater than its width or diameter. Such elongated articles include, but are not limited to, the following: construction materials, such as pipes, moldings, lumber, extrusions and the like; garden tools, such as rakes, hoes, shovels, picks and the like; and home cleaning tools, such as brooms, mops and the like.

Each of the plurality of holes 1001-1009 is dimensioned to accept an elongated articles. Suitable diameter for each of the plurality of holes in any given panel in the present invention, such as holes 1001-1009 in exemplary panel 10, is from about 1 mm to about 1000 mm, or about 10 mm to about 100 mm, or about 100 mm to about 500 mm, or about 10 mm to about 50 mm. The size of such hole may be determined empirically by one skilled in the art depending, for example, on the width or diameter of the articles intended to be stored, displayed and/or organized and the overall size of the panel.

The panels used in the inventive shelf system, such as the exemplary panel 10 shown in FIG. 1, may be made of any suitable material having a bending modulus sufficient to maintain the panel in a substantially planer form even when placed under a load. That is, the panels may be made of any material, or combination of materials, which does not bend or distort excessively when assembled into the inventive shelf system and a plurality of articles are placed in at least one of the plurality of holes. Illustrative examples of suitable materials for the panels include, but are not limited to, the following: woods, plastics, resins, polymers, metals, alloys, laminates, composites, fibers, papers and combinations of any two or more thereof. The panels in the inventive shelf system are all preferably made from the same material(s), although in certain embodiments they can be made from different materials. The panels may have a length and a width of about 4 inches to about 96 inches, or about 8 inches to about 48 inches, or about 8 inches to about 24 inches, or about 8 inches to about 16 inches. The panels may also be circular, elliptical, triangular, or polygonal in shape. The diameter of a circular or elliptical is about 4 inches to about 96 inches, and the length of any one side of a triangle or polygon is similar about 4 inches to about 96 inches.

Figure 2:
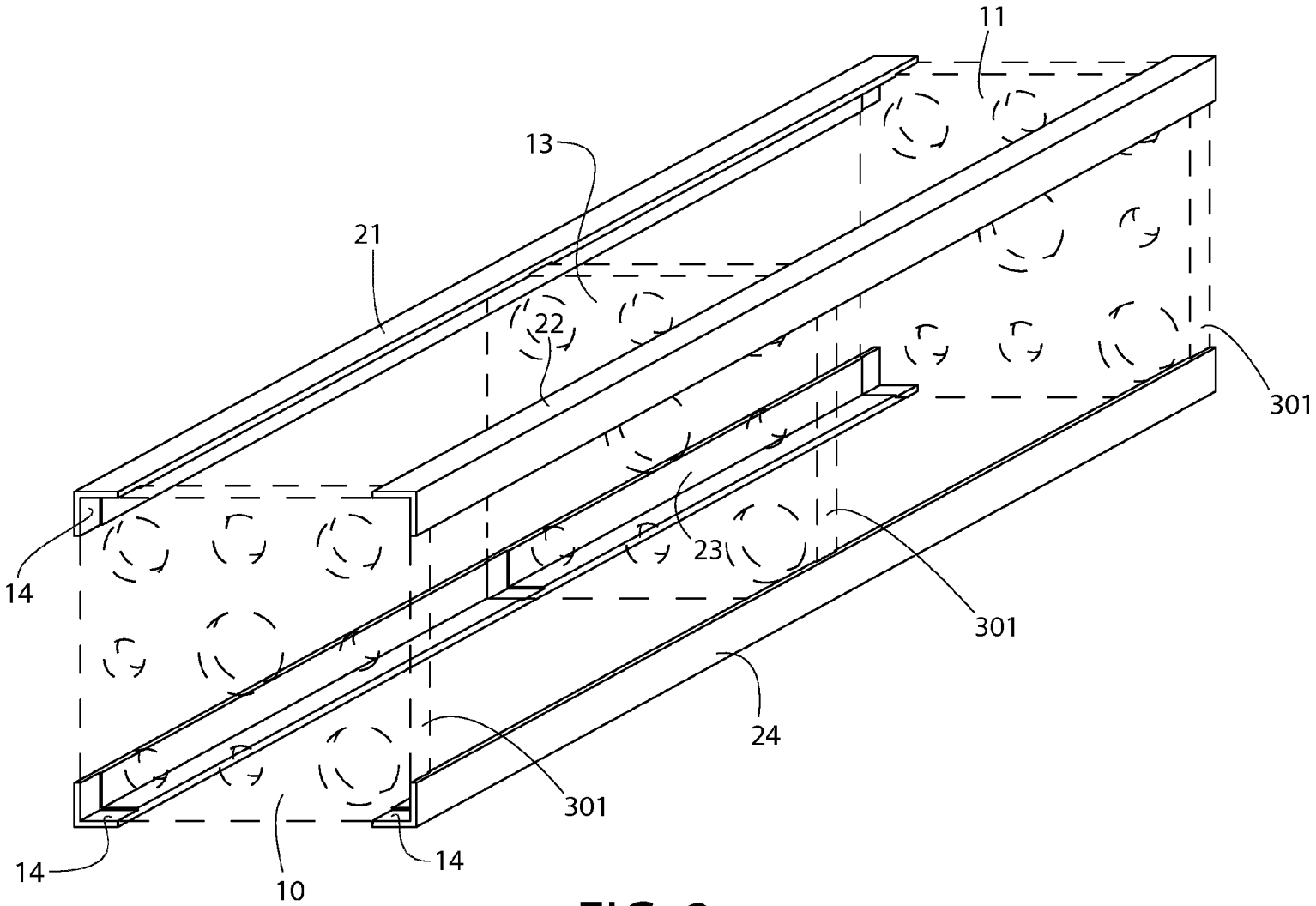
FIG. 2 shows an exemplary shelf system of the present invention, which has three panels 10, 11, and 13 and four substantially rigid members 21-24, as the means for maintaining said panels substantially parallel to one another at a predetermined distance apart, and a notch 14.

FIG. 2 shows an exemplary shelf system of the present invention, which has three panels 10, 11, and 13 and four substantially rigid members 21-24 as the means for maintaining said panels substantially parallel to one another at a predetermined distance apart. According to embodiments such as this, substantially rigid members 21-24 may be attached to either an edge or a surface of panels 10, 11 by any suitable method.

Suitable methods for attaching substantially rigid members 21-24 to panels 10, 11 may be determined empirically by one skilled in the art through routine experimentation. For example, substantially rigid members 21-24 may be attached to an edge 301 of panels 10, 11 by use of a combination of bolts, washers and free nuts fastened through holes in substantially rigid members 21-24 aligned with holes in the edge(s) of panels 10, 11. Alternatively, substantially rigid members 21-24 may be attached to a surface of panels 10, 11 by use of a bracket, with screws or bolts and nuts, or an adhesive, such as a glue or epoxy. Still other ways of attaching substantially rigid members 21-24 to panels 10, 11 include, but are not limited to, one or more of the following: captured nuts in combination with bolts, nuts (free or captured) in combination with screws, screws, rivets, welding, glues, epoxys, resins, acrylates and the like.

Each of the methods of for attaching substantially rigid members 21-24 to panels 10, 11 may be used alone or in combination with another way. For example, if substantially rigid members 21-24 are attached to a surface of panels 10, 11 by a weld, a bracket with bolts and nuts may also be used to further strengthen the shelf system.

FIG. 2 further shows the substantially rigid members 21-24 having a notch 14, for securing to panels 10, 11, and 13. Accordingly, the use of a notch 14, at end of each substantially rigid member 21-24 aids in maintaining the panels substantially parallel to one another at a predetermined distance apart. These substantially rigid members 21-24 may be made of any suitable material(s), i.e. any material or combination of materials that will maintain the panels substantially parallel to one another at a predetermined distance apart, and may be made from the same material(s) or from different material(s). Illustrative examples of suitable materials for the substantially rigid members include, but are not limited to, the following: woods, plastics, resins, polymers, metals, alloys, laminates, composites, fibers, papers and combinations of any two or more thereof.

Suitable equivalents of each of these various embodiments described above may also be used as the means for maintaining the panels substantially parallel to one another at a predetermined distance apart. The suitability of any potential equivalent may be determined empirically by one skilled in the art, for example by constructing a model shelf system using the potential equivalent and testing it under the intended load(s).

As noted above, the panels of the inventive shelf system are maintained at a predetermined distance apart. Distances between panels are about 4 inches to about 96 inches. In other embodiments distances between panels are about 4 inches to 48 inches, or about 8 inches to about 24 inches. This predetermined distance may be any distance suitable for storing, displaying and/or organizing the intended elongated articles. The suitability of any potential distance may be determined empirically by one skilled in the art based on the length of the articles to be stored, displayed and or organized or by constructing a model shelf system using the potential distance and testing it with the intended article(s).

Figure 3:
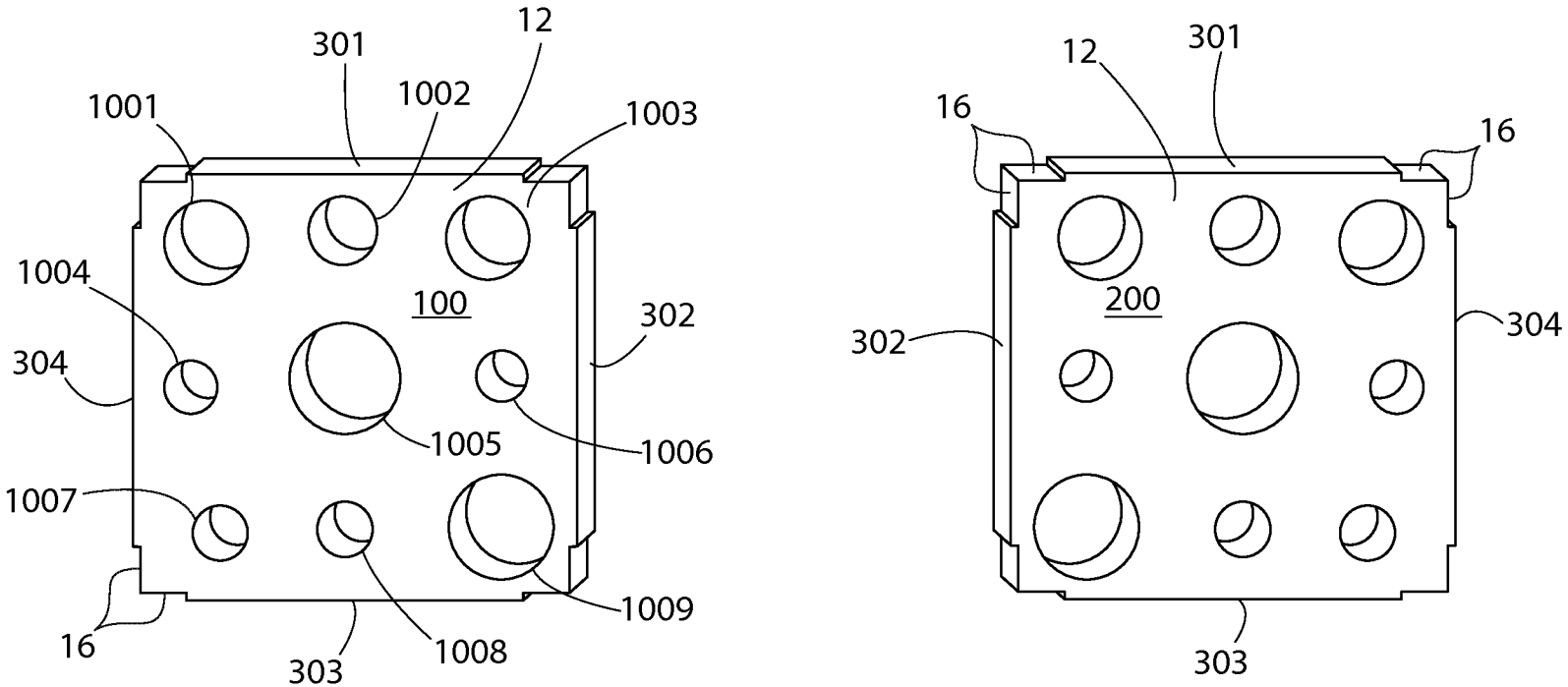
FIG. 3 shows an exemplary panel 12 that may be used in the inventive shelf system, having a panel notch 16.

FIG. 3 identifies an embodiment of a panel 12 of the invention described herein, having notches 16 in the corner of the panels. These notches 16 allow for substantially rigid members 21-24 (FIG. 2) to secure to the corner of the panels. Further, this provides a means to secure multiple panels 12 to substantially rigid members 21-24. The notches 16 guide the substantially rigid members 21-24 and provide a means for aiding in the alignment and securing of the substantially rigid members 21-24 to said panels 12.

In certain embodiments of the shelf system of the present invention, the means for maintaining the panels 12 substantially parallel to one another at a non-predetermined distance apart is adjustable, i.e. the non-predetermined distance may be changed if desired. For example, one mechanism for maintaining the panels substantially parallel to one another at a non-predetermined distance apart utilizes a panel 12 having grooves 16 for accepting a substantially rigid member. Said grooves 16 are situated on the edges 301-304 of said panel 12, and are located, in particular on the corners of said panel 12. Said grooves 16 having a length and a width to correspond to the dimensions of a substantially rigid member 21-24, to facilitate securing said panels 12 to said substantially rigid member 21-24.

In other embodiments, the panels may or may not have grooves 16, but the substantially rigid members 21-24 have grooves. In such an embodiment, a predetermined distance may be changed by moving one or both panels from one groove to another. Similar modifications may be performed on other embodiments of the inventive shelf system. Embodiments may include one or both of the substantially rigid member and the panels having grooves.

Figure 4:
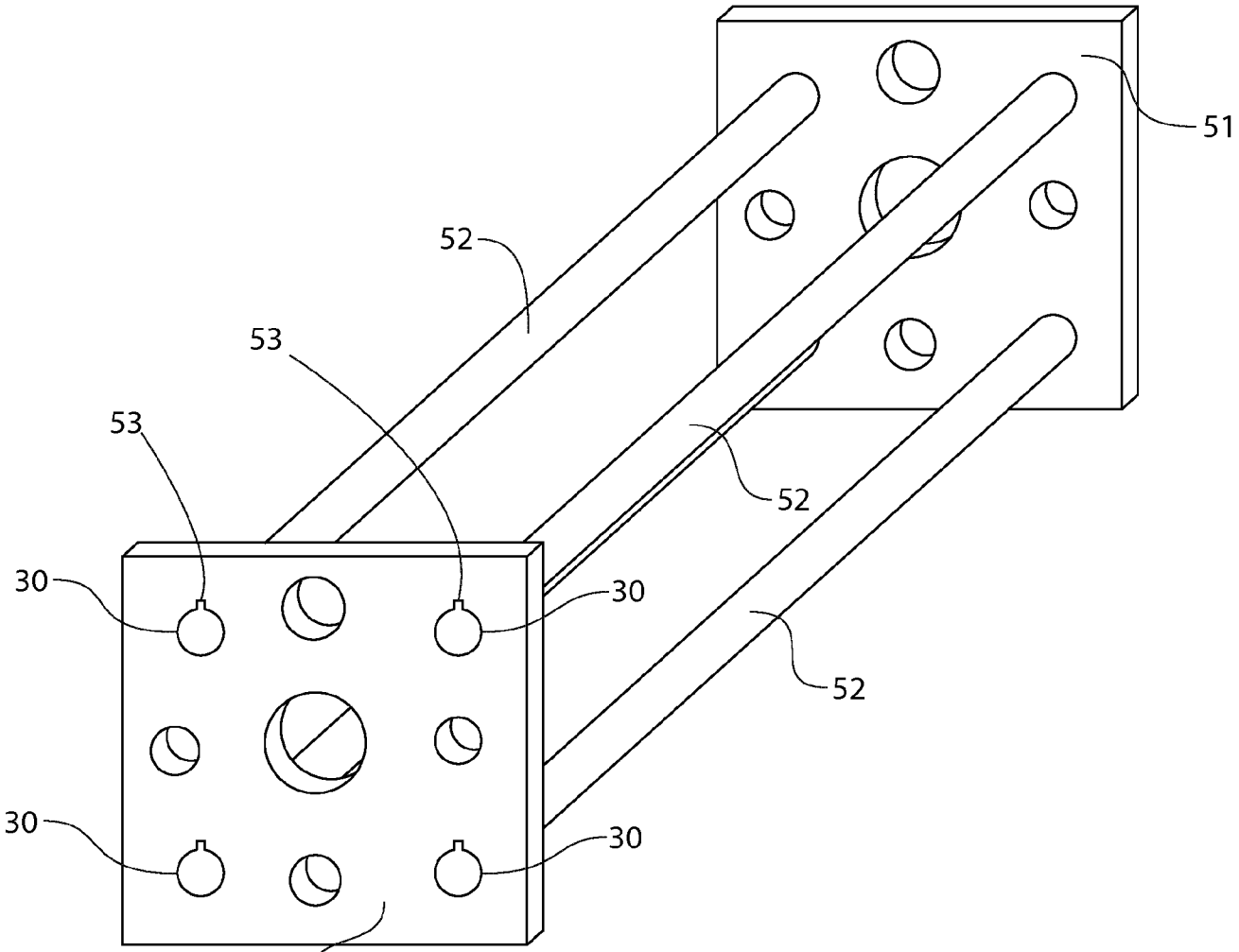
FIG. 4 shows an exemplary shelf system of the present invention, which has two panels 50, 51, and substantially rigid members 52, attaching to panel holes 30.

FIG. 4 shows an exemplary shelf system of the present invention, which has two panels 50, 51 and four panel support holes 30, in each panel. The panel support holes 30 extending from one side of the panel to the other, allowing a panel 50 or 51 to freely move along the substantially rigid members 52. The panel support holes 30 allowing a substantially rigid member 52 to be secured to the panel 50 or 51, to maintain the panels 50 and 51 substantially parallel to one another. The panel holes have a panel hole lock 53, such as a screw or nail or other fastening mechanism, to secure the panel 50 or 51 to the substantially rigid member 52. Additional panels, can be inserted onto substantially rigid members 52, and secured at non-predetermined distances between panels 50 and 51, by securing the panel to the rigid members 52, with the panel hole lock 53.

The panel hole lock 53 may be any number of locking mechanisms or typical fastening devices to secure one panel to a member inserted into said panel. Typical features include threaded fasteners or nails situated in a pocket hole of said panel 50, 51, such that the panel hole lock 53 secures the panel 50, 51, to a particular point on the substantially rigid member 52. Other locking means may also be utilizes as is known to one of ordinary skill in the art.

Figure 5:
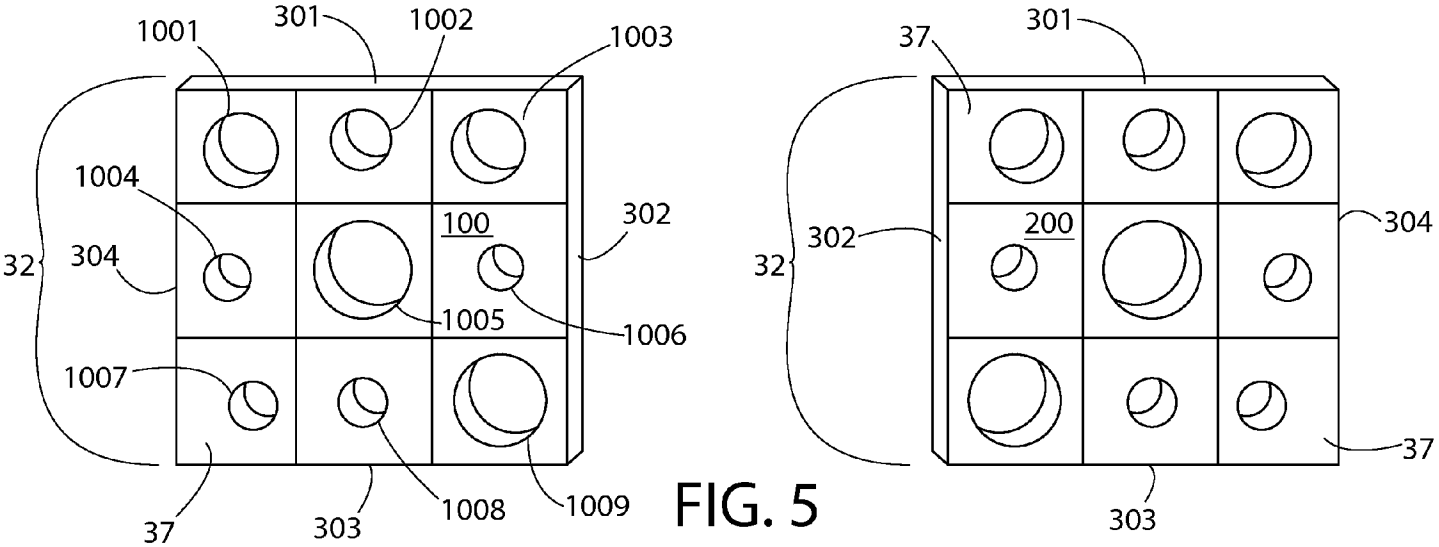
FIG. 5 shows exemplary modular panels 32 of the inventive shelf system identified herein.
Figure 7:
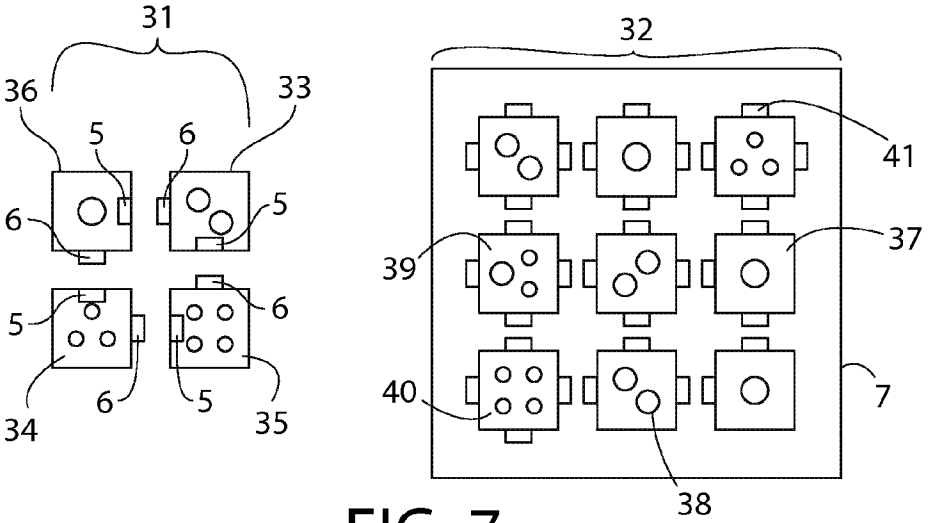
FIG. 7 shows two variations of exemplary modular panels 31 and 32, and mechanisms for connecting modular inserts to said panels.

FIG. 5 shows a modular panel 32 having a first surface 100 and a second surface 200, and holes 1001-1009 between said panel 32. The modular panel, having nine modular inserts 37, that make up the modular panel 32. Each modular insert 37, may be located at any one of the nine positions, allowing the panel 32 to be modified based on consumer needs. Each insert 37, may have a single hole, 1001, or, as shown in FIG. 7 have more than one hole in each insert 37. Each insert may have from 0 to 16 holes. Typically inserts have about 1 to 9 holes, and about 1 to 4 holes per insert. The holes on each insert may be the same size or different sizes (see insert 39 in FIG. 7).

Figure 6:
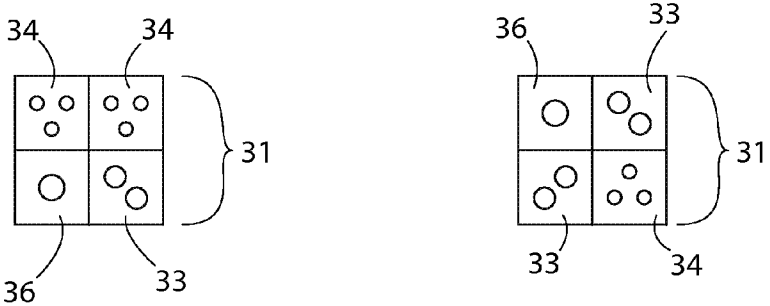
FIG. 6 shows exemplary modular panels 31 of the inventive shelf system identified herein.

FIG. 6 shows additional modular panels 31, having four inserts 33-36, having between one and three holes per insert. The four inserts 33-36 combine to from the modular panel 31. Each insert 33-36 may include the same number of holes or different number of holes as is necessary. Each insert has a first surface and a second surface, and has four sides. In essence, each insert is a small panel, that can be combined together to form a larger single panel. The sides of each insert comprise a locking mechanism to secure each insert to one another. Further, means to secure each insert to one another may also be on said first and second surfaces.

FIG. 7 shows two variations of modular panel inserts, 33-36 and 37-40, being part of a 2×2 modular insert panel, or a 3×3 modular panel insert. FIG. 7 further shows two variations of attachment mechanisms between the panel inserts. The panel inserts may utilize a key 6 and keyhole 5 type locking mechanism, or use a notch mechanism 41. Other attachment mechanisms to lock the panels together are widely known in the art, such as tongue and groove, clips, post and hole, latches, etc. The panel on the left can combine all four panels inserts 33-36 together, to create a single panel 31. The panel on the right, in contrast, combines the panel inserts 37-40 together with a panel support 7, that surrounds and attaches to the panel inserts, to create a secure panel 31.

Modular panels allow for a completely customizable panel based on the needs of an end user. Thus, different sized holes, different shapes, and various number of holes in each panel are possible. Thus, an end user may customize a panel based on the needs of each individual user.

Figure 8:
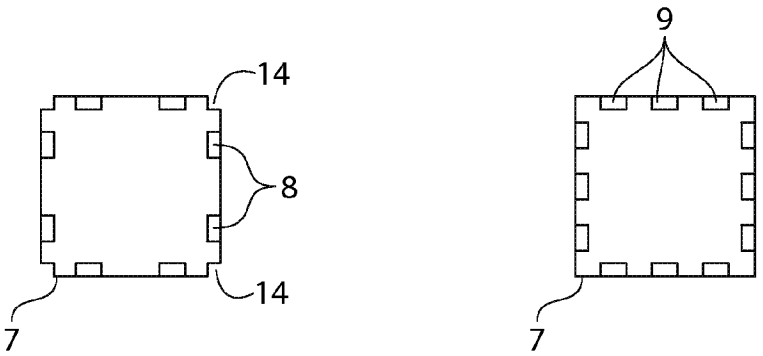
FIG. 8 shows two examples of modular panel supports to secure modular inserts to said panels.

FIG. 8 identifies two panel supports 7, for various embodiments of a modular panel. Each panel support 7 has attachment mechanisms compatible with the panel inserts 33-36 and 37-40, to allow the panel to be locked together. The panel on the left further includes notches 14, on the corners of the panel, whereas the panel on the right has no notches on the edges of the panel.

Figure 9:
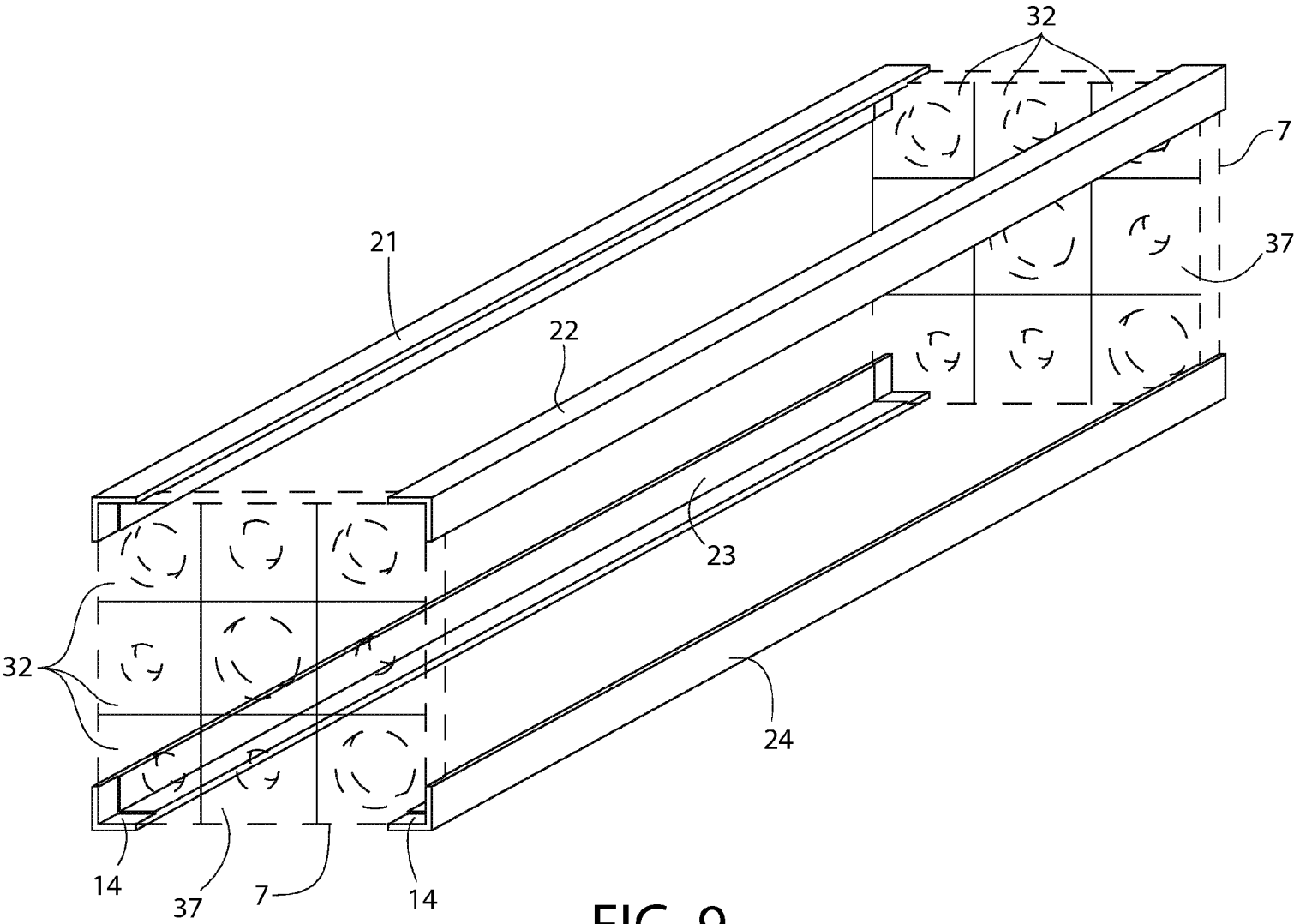
FIG. 9 shows an exemplary shelf system of the present invention, which has two modular panels 32, connected to substantially rigid members having notches 14 for connecting to said modular panels.

FIG. 9 identifies a modular shelf system comprising at least two modular panels and substantially rigid support members 21-24, each having notches 14 disposed at the end of each rigid member. In certain embodiments the notches 14 on the substantially rigid support member 21-24 may be eliminated.

Figure 10:
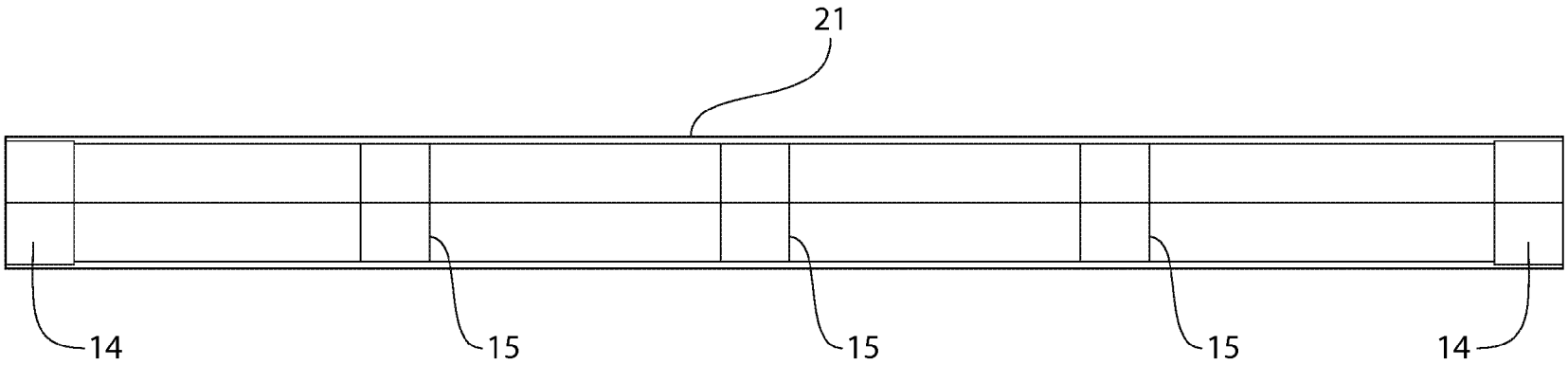
FIG. 10 shows an exemplary substantially rigid member having multiple notches for securing panels in specified locations.

FIG. 10 identifies a notches on a substantially rigid support member 21, having notches 14 disposed at each end of the rigid support member as well as notches 15 disposed at intervals over the length of the substantially rigid support member 21. The notches 15 have a dimension that is slightly larger than the dimension of the edge of the panel, which allows for panels to be secured at these locations and to maintain each panel substantially parallel to the other panels.

Figure 11:
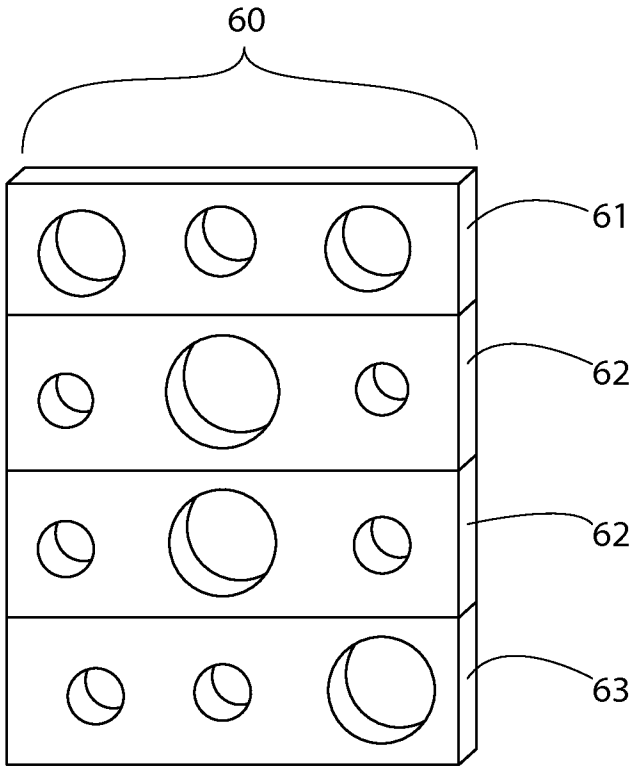
FIG. 11 shows an exemplary modular panel 60, having four modular inserts.

FIG. 11 further identifies a modular panel 60, having four inserts 61-63, that may be secured together to create a modular panel 60. Each insert 61-63 has different sized holes to allow for a customizable panel.

Although the detailed description of preferred embodiments above contain many details and specifics, these should not be construed as limiting the scope of the invention in any way, but rather as merely providing illustrative examples of some of the presently preferred embodiments of this invention. For example, the holes in the panels may be any suitable shape, including round, square, rectangular, or irregularly shaped holes depending upon the article(s) being stored, displayed and/or organized. There may be three or four or more panels in the shelf system. And the system may comprise various inserts 33-40 in combination with insets 61-63 as is practicable. Accordingly, the invention is a modular system that comprises a plurality of inserts to form a modular, customizable panel, for storing elongated articles.

The foregoing description and the following examples are illustrative only and are not intended to limit the scope of the invention as defined by the appended claims. It will be apparent to those skilled in the art that various modifications and variations can be made in the methods of the present invention without departing from the spirit and scope of the invention. Thus, it is intended that the present invention cover the modifications and variations of this invention provided they come within the scope of the appended claims and their equivalents.

Among the advantages of the present invention are: (a) simple, i.e. typically made of few parts and easy to assemble; (b) inexpensive to manufacture; (c) sturdy when free standing; (d) adjustable; (e) easy to store, organize and/or display elongated articles in a neat arrangement in which all articles are equally accessible and protected from damage; (f) versatile; (g) easy to mass produce; (h) lightweight, i.e. typically made of plastics or light metal composite material; (i) corrosion resistant, i.e. typically made of light metal composite material or plastics; and (j) and fully modular with respect to each panel.

It is to be understood that both the foregoing general description and the following detailed description are exemplary and explanatory only and are intended to provide further explanation of the invention as claimed.

What is claimed is:

1. A modular shelf system comprising: (i) at least two modular panels of predetermined size and shape; and (ii) means for maintaining said modular panels substantially parallel to one another at a predetermined distance apart, wherein each of said modular panels is defined by fitting together a plurality of interchangeable modular inserts configured to form said panel, said individual modular inserts having different patterns or number of holes extending through each of the modular inserts and wherein each said modular insert is a single piece, having a first surface and a second surface and an edge and contains at least one hole extending completely through said modular insert from said first surface to said second surface, wherein the edges of said inserts secure together to form said modular panel having a plurality of holes; wherein said plurality of holes are dimensioned to accept a plurality of articles to be stored, wherein each of said panels comprises a material having a bending modulus sufficient to maintain said panel in a substantially planer form even when placed under a load, and wherein said panels are arranged such that at least one hole on one of said panels is substantially aligned with at least one hole on the other of said panels, and wherein each of said modular insert is exchangeable with another modular insert having a different pattern or number of holes extending through said modular insert, wherein exchange of one of said modular inserts a modular insert thereby modifies the configuration of the modular panel.

2. The shelf system according to claim 1, wherein said means for maintaining said panels parallel to one another at a predetermined distance apart comprises a plurality of substantially rigid members, each of said substantially rigid members having a first end and a second end and a length equal to said pre-determined distance.

3. The shelf system according to claim 2, wherein said means for maintaining said panels parallel to one another at a predetermined distance apart further comprises one or more means for affixing an end of each of said rigid members to a surface of each of said panels.

4. The shelf system according to claim 2, wherein each of said panels further contains a second plurality of holes dimensioned to accept and hold an end of each of said rigid members, and wherein said panels comprise a locking mechanism to secure said panel to said rigid members.

5. The shelf system according to claim 1, wherein said means for maintaining said panels parallel to one another at a pre-determined distance apart comprises a plurality of rigid members, each of said rigid members having a first end and a second end and a length greater than said predetermined distance.

6. The shelf system according to claim 5, wherein said means for maintaining said panels parallel to one another at a pre-determined distance apart further comprises one or more means for affixing each of said rigid members to an edge of each of said panels.

7. The shelf system according to claim 2, wherein each of said rigid members contains at least one groove dimensioned to accept and hold an edge of one of said panels.

8. The shelf system according to claim 2, wherein each of said panels contains at least one groove dimensioned to accept and hold one of said rigid member.

9. The shelf system according to claim 1, wherein each of said panels individually comprises at least one material selected from the group consisting of: woods, plastics, resins, polymers, metals, alloys and combinations of any two or more thereof.

10. The shelf system according to claim 1, further comprising a third panel of predetermined size and shape, having a means for maintaining said third panel at a predetermined distance from said at least two panels, and wherein said third panel comprises a plurality of modular inserts configured to combine together to form said panel, and wherein each said modular insert has a first surface and a second surface and an edge and contains at least one hole extending completely through said modular insert from said first surface to said second surface, wherein the edges of said inserts secure together to form said panel having a plurality of holes; wherein said plurality of holes is dimensioned to accept a plurality of articles to be stored, wherein said panel comprises a material having a bending modulus sufficient to maintain said panel in a substantially planer form even when placed under a load, and wherein said panels are arranged such that at least one hole on one of said panels is substantially aligned with at least one hole on the other of said panels.

11. The shelf system of claim 10, wherein the predetermined distance between said third panel and one of said at least two panels is substantially equal to the predetermined distance between said at least two panels.

12. The shelf system of claim 10, wherein the predetermined distance between said third panel and one of said at least two panels is substantially less than the predetermined distance between said at least two panels.

13. The shelf system of claim 12, wherein the predetermined distance between said third panel and one of said at least two panels is substantially greater than the predetermined distance between said at least two panels.

14. The shelf system according to claim 12, further comprising a fourth panel of predetermined size and shape, wherein said third panel comprises a plurality of modular inserts configured to combine together to form said panel, and wherein each said modular insert has a first surface and a second surface and an edge and contains at least one hole extending completely through said modular insert from said first surface to said second surface, wherein the edges of said inserts secure together to form said panel having a plurality of holes; wherein said plurality of holes is dimensioned to accept a plurality of articles to be stored, wherein said panel comprises a material having a bending modulus sufficient to maintain said panel in a substantially planer form even when placed under a load, and wherein said panels are arranged such that at least one hole on one of said panels is substantially aligned with at least one hole on the other of said panels.

15. The shelf system of claim 14, wherein the predetermined distance between any two adjacent panels is substantially equal to the predetermined distance between any other two adjacent panels.

16. The shelf system of claim 14, wherein the predetermined distance between any two adjacent panels is not substantially equal to the predetermined distance between any other two adjacent panels.

17. The shelf system according to claim 1, wherein said means for maintaining said panels parallel to one another at a predetermined distance apart can be adjusted to change said predetermined distance.

18. The shelf system according to claim 1 further comprising a panel support that surrounds and attaches to the panel inserts around the perimeter of the modular panel.

19. A modular shelf system comprising: (i) a plurality of single piece modular inserts that secure together to form a modular panel, said individual modular inserts having different patterns or number of holes extending through each of the modular inserts (ii) a panel support, (iii) at least two modular panels of predetermined size and shape; and (iv) means for maintaining said modular panels substantially parallel to one another at a predetermined distance apart, wherein said plurality of modular inserts comprise a first surface and a second surface and four edges and contains at least one hole extending completely through said modular insert from said first surface to said second surface, wherein the modular inserts have securing means disposed of on each of the four edges to secure each of said modular inserts to one another, and wherein a panel support provides an outer supporting mechanism that secures to the outer perimeter edges of the secured modular inserts to form said modular panel; wherein said plurality of holes is dimensioned to accept a plurality of articles to be stored, wherein each of said panels comprises a material having a bending modulus sufficient to maintain said panel in a substantially planer form even when placed under a load, and wherein said panels are arranged such that at least one hole on one of said panels is substantially aligned with at least one hole on the other of said panels, and wherein each of said modular insert is exchangeable with another modular insert having a different pattern or number of holes extending through said modular insert, wherein exchange of one of said modular inserts thereby modifies the configuration of the modular panel.

* * * * *